United States Patent [19]

Shelton et al.

[11] Patent Number: 4,502,291

[45] Date of Patent: Mar. 5, 1985

[54] COMBINATION FAN MOTOR AND ORIFICE SUPPORT ASSEMBLY

[75] Inventors: Edward B. Shelton, Liverpool; Richmond S. Hayes, Jr., Fayetteville; Robert M. Kozlowski, Syracuse, all of N.Y.

[73] Assignee: Carrier Corporation, Syracuse, N.Y.

[21] Appl. No.: 450,391

[22] Filed: Dec. 16, 1982

[51] Int. Cl.[3] ..... F25D 21/14

[52] U.S. Cl. ..... 62/285; 62/263; 62/297; 248/637; 415/219 R; 417/360; 417/423 R

[58] Field of Search ..... 62/285, 291, 297, 262, 62/263; 415/219 R; 417/360, 423 R; 248/637

[56] References Cited

U.S. PATENT DOCUMENTS

| | | | |
|---|---|---|---|
| 1,975,066 | 9/1934 | Sanderson | 62/285 |
| 2,115,527 | 4/1938 | Hueglin | 417/423 R |
| 2,558,541 | 6/1951 | Cotten | 417/423 R |
| 3,317,124 | 5/1967 | Morrill | 417/423 R |
| 3,699,873 | 10/1972 | Irvin | 62/262 |
| 3,759,158 | 9/1973 | Henry et al. | 417/360 |
| 4,394,111 | 7/1983 | Wiese et al. | 417/360 |

*Primary Examiner*—Ronald C. Capossela
*Attorney, Agent, or Firm*—Robert H. Kelly

[57] ABSTRACT

A combination fan motor and orifice support assembly including a plurality of fan motor support legs and a plurality of fan orifice supports all integrated to support both the fan motor and the fan orifice are disclosed. Additionally, tube supports for securing the loops of a wound fin heat exchanger in appropriate position are disclosed for providing further structural support to the fan orifice and therethrough to the entire support assembly.

9 Claims, 4 Drawing Figures

COMBINATION FAN MOTOR AND ORIFICE SUPPORT ASSEMBLY

BACKGROUND OF THE INVENTION

1. Field of the Invention

The present invention relates to a support assembly for securing both a fan motor and a fan orifice within an air conditioning unit. More specifically, the present invention relates to an air conditioning unit including a plurality of fan support legs and fan orifice supports integrated to provide a structural arrangement for securing a fan and a fan orifice in an air conditioning unit. Tube supports for providing support for a heat exchanger are additionally integrated to provide structural support to the fan orifice.

2. Prior Art

Wound fin heat exchangers are well known in refrigeration and air conditioning fields. A wound fin heat exchanger consists of a tube having a fin material wrapped about the tube in heat exchange relation therewith to promote heat transfer between fluid flowing through the tube and a separate fluid flowing over the tube. The utilization of this type of heat exchanger has been found to be both cost effective and to provide the appropriate heat transfer surface with a minimum of tube length.

To make advantageous use of wound fin heat exchangers, it is necessary that the heat exchanger be configured to optimize heat transfer. Additionally, since the heat exchanger is made from a single length of wound fin tubing, the heat exchanger is typically formed in a peripherally encasing configuration such as an annular or other configuration having an opening in the middle. As disclosed herein, the peripherally encasing heat exchanger will be generally rectangular in cross section defining an opening in the center.

When utilizing a peripherally encasing heat exchanger having a central opening in combination with a vertically packaged unit, if the heat exchanger is sufficiently large to encase the entire outdoor portion of the packaged unit, it is necessary to provide appropriate structural support for maintaining the heat exchanger in the desired configuration about the exterior of the appropriate section of the heat exchange unit.

Since the heat exchanger is mounted about the periphery of the unit and extends generally horizontally from a vertical partition dividing the vertical packaged unit into an outdoor and indoor section, it is necessary to mount the fan motor and fan orifice for coacting with the fan to circulate the air in the central opening defined by the heat exchanger. It is additionally necessary to provide appropriate structural support for securing the fan motor and the orifice such that they extend generally horizontally from the partition.

The present invention concerns the provision of fan motor support legs for securing the fan motor and fan orifice supports connected to the fan motor support legs for securing one side of the fan orifice. Additionally, tube supports for securing the heat exchanger are provided which may be engaged to the opposite side of the fan orifice to provide an integrated structural assembly for securing the fan motor, the fan orifice and heat exchanger.

SUMMARY OF THE INVENTION

It is an object of the present invention to provide apparatus for supporting a fan motor of a heat exchange unit.

It is a further object of the present invention to provide apparatus for supporting the fan orifice in position relative to a rotating fan.

It is a further object of the present invention to provide a combination support assembly for providing structural support from a vertical partition to both a fan motor connected to a fan and a fan orifice.

It is a yet further object of the present invention to provide an integrated support assembly including tube supports for supporting a heat exchanger which are engaged to the fan orifice to support the orifice in combination with other fan orifice support structures.

It is another object of the present invention to provide a durable, vibration resistant support assembly for securing components in an air conditioning unit.

A still further object of the present invention is to provide a safe, economical, reliable and easy to install and manufacture combination fan motor and orifice support assembly for use with a heat exchange unit.

Other objects will be apparent from the description to follow and the appended claims.

The above objects are achieved according to the preferred embodiment of the invention by the provision of a support assembly for use in a heat exchange unit for separately securing a fan motor connected to power a fan and a fan orifice coacting with the fan which directs air through the fan orifice. A plurality of fan motor support legs each including an extension portion connected to a vertical member from which the fan motor and orifice are supported and a securing portion angled from and connected to the extension portion are disclosed, said securing portion including means for supporting the fan motor. Additionally, a plurality of fan orifice supports, each including fastening means for securing the fan orifice support to the fan orifice, a connection portion which is secured to the support leg and an extension portion connecting the fastening means to the connection portion whereby the fan motor and fan orifice are both secured to the vertical member.

A heat exchange unit having an outdoor section defined in part by a vertically extending partition is likewise disclosed. The heat exchange unit includes a peripherally encasing wound fin heat exchanger defining a central opening, a plurality of spaced tube support assemblies for maintaining the wound fin heat exchanger in the desired configuration, said tube support assemblies being mounted to a partition for supporting the heat exchanger and a leg assembly connected to the partition for supporting a fan motor and a fan orifice within the opening defined by the heat exchanger, and wherein the fan orifice is also secured to at least one of the tube support assemblies to maintain the fan orifice in the desired position.

DESCRIPTION OF THE PREFERRED EMBODIMENT

The embodiment as described herein is adapted for use in a vertically mounted packaged heat pump as may be used to provide conditioned air to an apartment, condominium or similar structure including single family dwellings. The unit is designed to be mounted having an outdoor section in communication with outdoor ambient air and an indoor section for delivering conditioned air to the enclosure. The support assembly for securing the fan motor and the fan orifice together with the heat exchanger support assembly for additionally securing the fan orifice are particularly suitable for use in a unit having a vertically extending partition with a peripherally encasing heat exchanger defining a central opening. The tube support structure is particularly suitable for use with a wound fin type heat exchanger. However, it is apparent that such a device would have applicability in heat exchange units having heat exchangers of various configurations and made from various types of fin or other heat transfer material. It is further to be understood that although a particular packaged type heat pump is described herein, this invention would have like applicability to other air conditioning units that are neither heat pumps nor packaged units.

Figure 1:
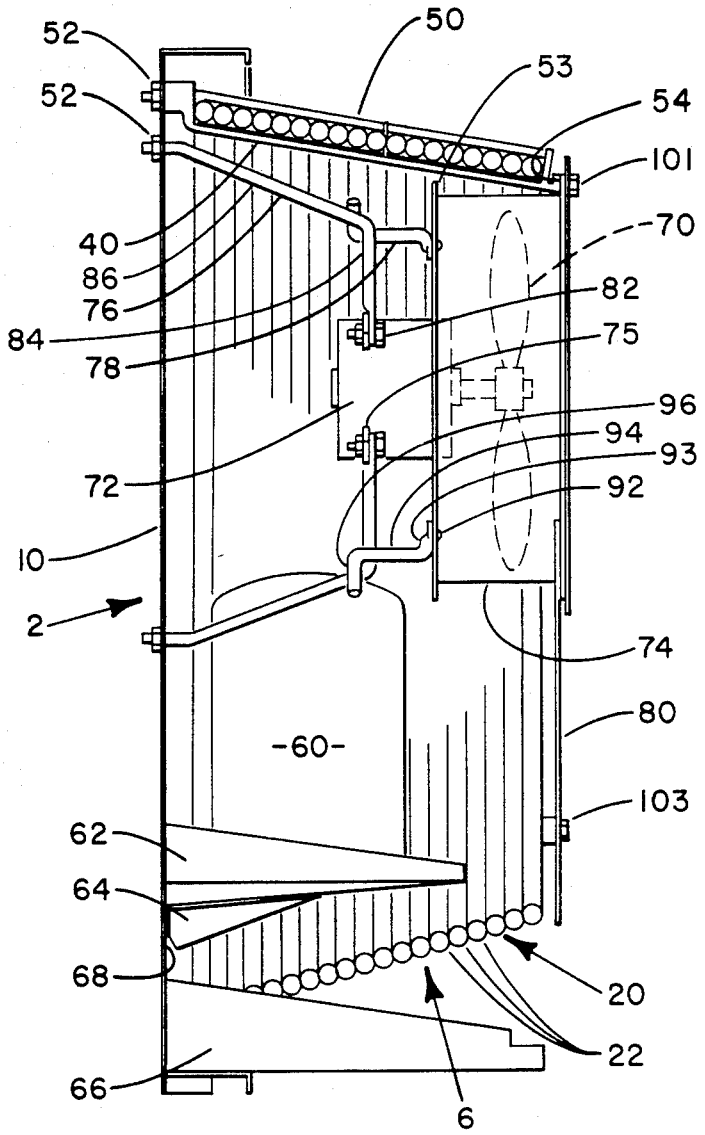
FIG. 1 is a partially cutaway side view of the outdoor section of a vertically mounted packaged air conditioning unit.

Referring now to FIG. 1, there may be seen the outdoor portion of a vertically mounted packaged air conditioning unit. Partition 10 is a vertically extending support member which defines the boundary between outdoor section 6 and the indoor section (not shown). Heat exchanger 20 is shown mounted within the outdoor section and has compressor 60 and outdoor fan 70 mounted therewithin. Fan support legs 76 are shown secured to fan motor 72 to maintain the fan motor in position relative to partition 10. Fan orifice supports 78 further connect fan orifice 74 to fan motor support legs 76 to maintain the fan orifice in position.

Tube support 40 is shown at the top of the unit having loops 22 of heat exchanger 20 located between tube support 40 and rod 50. Additionally, it can be seen that nuts 52 are engaged to rod 50 and to support leg 76 as well as other components to secure same to the partition. Compressor 60 of the refrigeration circuit is mounted on compressor support 62 which additionally serves to collect condensate dripping from the upper portions of the heat exchanger. Drain bracket 64 serves to provide structural support to compressor support 62 and to direct condensate collected therewithin to drain pan 66 through opening 68. Mounted about the exterior of the outdoor section may be seen front guard 80 which prevents air flow into that portion of the central opening defined by the heat exchanger which is not encompassed by the fan orifice. It can additionally be seen that screws 101 and 103 act to secure both the fan orifice 74 and front guard 80 to the appropriate tube supports. It can also be seen that fan orifice 74 includes an orifice bottom lip 53 which is secured via bolts 92 to the orifice supports 78. Each orifice support 78 includes an extension portion 94 connected to a fastener portion 93 which is secured by bolt 92 to the orifice bottom lip and to a connection portion 96 which is typically welded at multiple points to support leg 76. Orifice 74 also includes orifice top lip 54 which may be engaged via screw 101 to tube support 40. Screw 103 is shown securing front guard 80 to a separate tube support.

It may be additionally seen that fan support leg 76 is formed from extension portion 86 and securing portion 84. Bolt 82 acts to engage securing portion 84 of the support leg to fan motor extension 75 to provide support to the fan motor.

Figure 4:
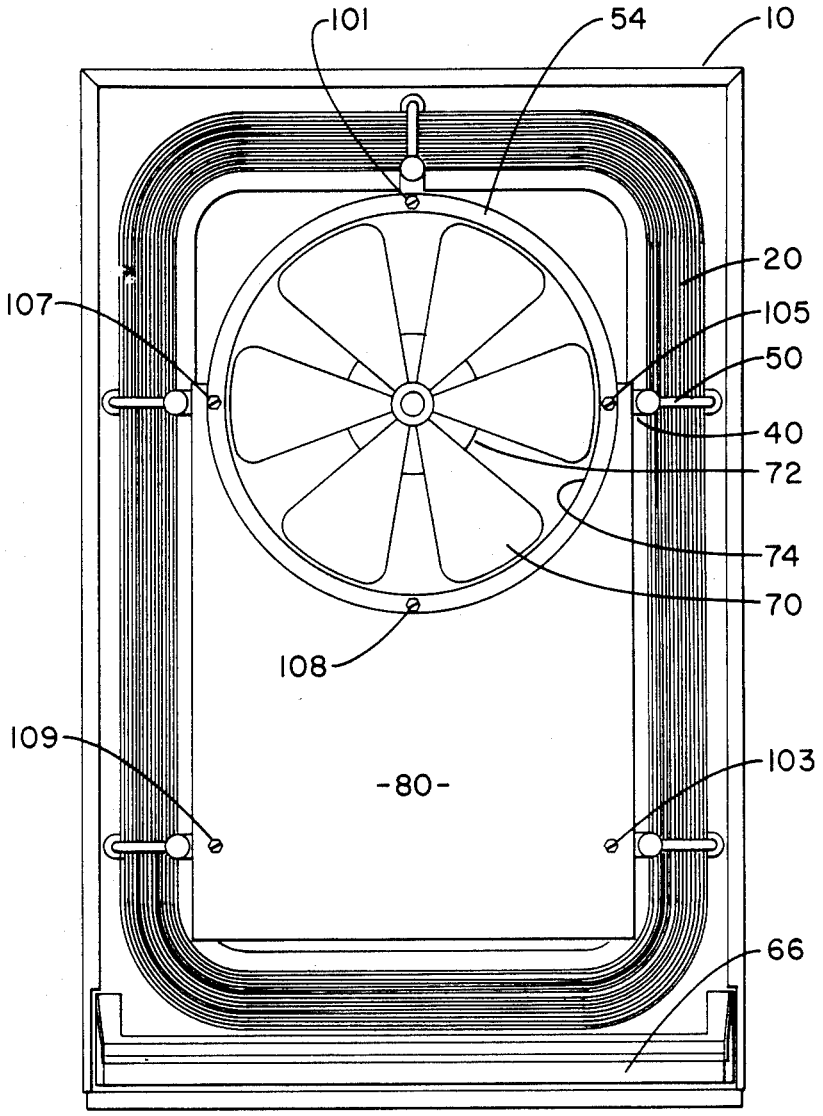
FIG. 4 is an end view of the outdoor portion of the heat exchange unit.

It may additionally be seen in FIG. 1 that heat exchanger 20 is made from loops 22 of wound fin heat exchange tubing wrapped to define a peripherally encasing heat exchanger having a central opening. As shown in FIG. 1, this heat exchanger is generally tapered from the partition outwardly and as may be seen in FIG. 4 is generally rectangular in configuration.

Figure 2:
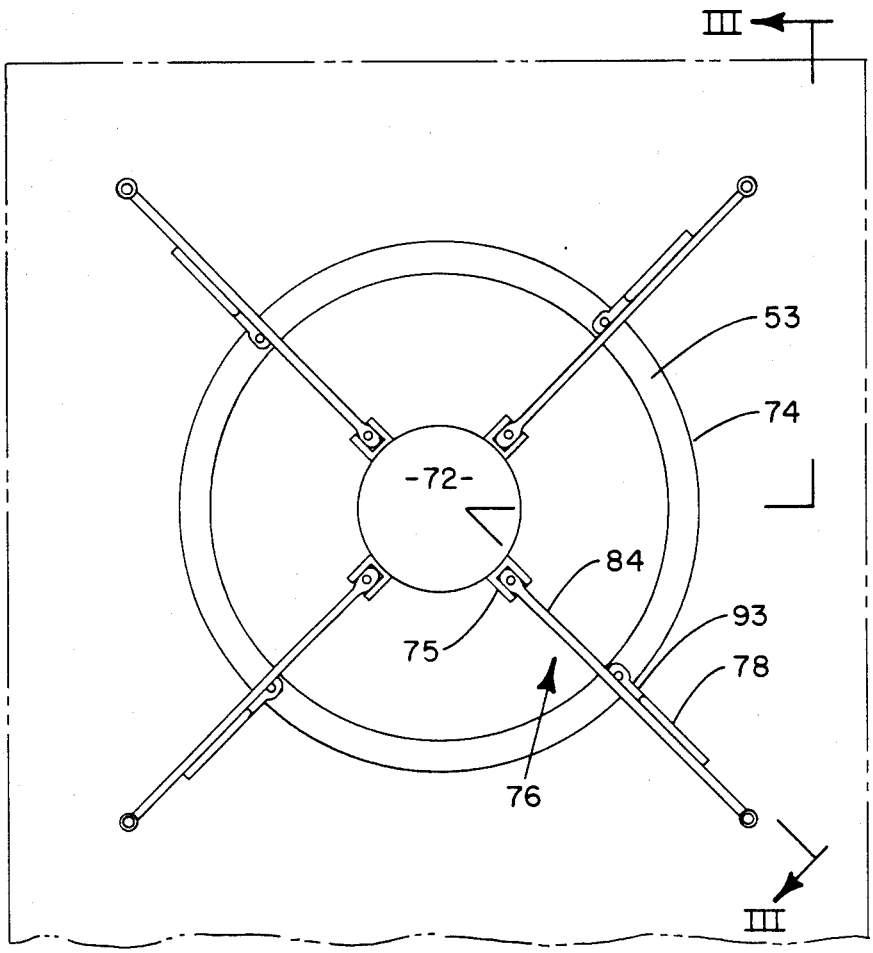
FIG. 2 is a back view of the combination fan motor and orifice support assembly.

Referring now to FIG. 2 there may be seen a view of the support assembly looking outwardly from partition 10. Fan motor 70 is shown located in the center of fan orifice 74 having bottom lip 53. Fan motor 72 is shown having extensions 75 to which securing portions 84 of fan support legs 76 are fastened. Fan orifice supports 78 are shown connected to fan support legs 76. It can be additionally seen that fan orifice supports 78 are connected to bottom support lip 53 of the fan orifice. Fastening portion 93 of the fan orifice support is additionally indicated.

Figure 3:
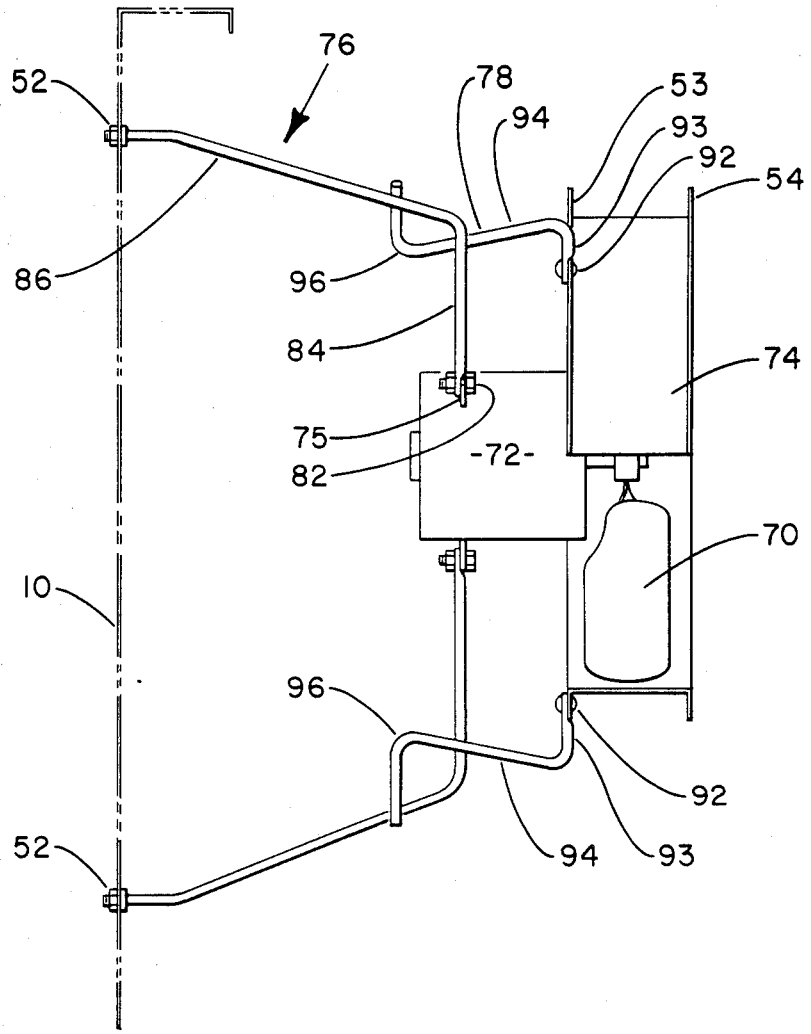
FIG. 3 is a side view taken along line III—III of FIG. 2 showing the various components of the support assembly.

FIG. 3 is a view of FIG. 2 taken along line III—III. As may be seen, line III—III is drawn such that a full side view of the support structure may be seen in the bottom half of FIG. 3 and an angled view of the structure may be seen in the top half of FIG. 3. More particularly in FIG. 3 it may be seen that fan support legs 76 are positioned such that nuts 52 connect same to partition 10. Extension portion 86 of fan support leg 76 is angled from the portion that protrudes through partition 10 and is connected to securing portion 84 angled from extension portion 76. Securing portion 84 is connected via bolt 82 to extension 75 from fan motor 72.

Additionally, it may be seen that fan orifice support 78 is divided into several segments including an extension portion 94 connected at one end to connection portion 96 and the other end to fastening portion 93 which is secured by bolt 92 to the bottom orifice support lip 53. It may be seen that the fan support legs 76 and the connection portion 96 of fan orifice support 78 intersect twice. By providing this angled arrangement with multiple intersections, a weld at each juncture will provide a strongly supported joint between the fan support leg and the fan orifice support. Additionally, it may be seen that fan 70 is mounted to fan motor 72 within fan orifice 74. Top lip 54 of the fan orifice is additionally indicated.

Referring now to FIG. 4 there may be seen a front end view of the outdoor section of the unit. Therein it can be seen that fan 70 is mounted within fan orifice 74 and is connected to be powered by fan motor 72. Fan orifice top lip 54 is shown extending about the circumference of fan orifice 74 and defines openings through which screws 101, 105, 108 and 107 extend. Heat exchanger 20 is shown as a peripherally encasing wound fin heat exchanger defining a central opening. The central opening is covered by fan guard 80 and fan orifice 74. Fan guard 80 is secured via screws 103 and 109 to the appropriate fan supports. Screws 101, 105 and 107 all secure either fan orifice top lip 54 or either front guard 80 to the appropriate tube supports 40. Fastener 108 secures the fan orifice top support lip 54 to front guard 80. Drip pan 66 is shown located at the bottom of the unit to collect condensate dropping from the heat exchanger 20.

The combination of a fan motor and orifice support utilizing both fan support legs and fan orifice supports taken together with the tube supports of the heat exchanger all act to form an integrated structural assembly for maintaining a fan motor and fan orifice in position such that noise, vibration and a potential for malfunction are reduced.

The invention has been described herein with reference to a particular embodiment. It is to be understood by those skilled in the art that variations and modifications can be effected within the spirit and scope of the invention.

What is claimed is:

1. A support assembly for use in a heat exchange unit for separately securing a fan motor connected to power a fan and a fan orifice coacting with the fan such that the fan directs air through the fan orifice which comprises:

a plurality of fan motor support legs each including an extension portion connected to a vertical member from which the fan motor and orifice are supported and a securing portion angled from and connected to the extension portion, said securing portion including fastening means adapted to engage a fan motor extension means for supporting the fan motor;

a plurality of fan orifice supports each including fastening means for securing the fan orifice support to the support leg and an extension portion connecting the fastening means to the connection portion whereby the fan motor and fan orifice are both secured to the vertical member; and top and bottom lips each mounted about the circumference of the fan orifice and extending outwardly therefrom and wherein the fastening means of the fan orifice support is secured to the bottom orifice lip.

2. The apparatus as set forth in claim 1 wherein the connection portion of the fan orifice support is configured to include portions angled from each other and wherein the connection portion is affixed to the motor support legs adjacent where the securing portion joins the extension portion such that the fan orifice support connection portion is positioned adjacent both the securing portion and the extension portion of the fan motor support leg whereby the fan orifice support may be secured at two locations to the fan motor support leg.

3. The apparatus as set forth in claim 1 and further comprising:

a peripherally encasing heat exchanger defining a central opening wherein the fan orifice is located; and tube supports connected to the vertical member and to the heat exchanger to maintain the heat exchanger in position, at least one of said tube supports also being connected to the top lip of the fan orifice to further secure the fan orifice in the desired position.

4. The apparatus as set forth in claim 3 and further comprising a front guard which encloses a portion of the central opening other than where the fan orifice is located to prevent air flow through the central opening other than through the fan orifice, said front guard being secured to several tube supports and to the top lip of the fan orifice to further secure the fan orifice in position.

5. A heat exchange unit having an outdoor section defined in part by a vertically extending partition which comprises:

a peripherally encasing wound fin heat exchanger defining a central opening;

a plurality of spaced tube support assemblies for maintaining the wound fin heat exchanger in the desired configuration, said tube support assemblies being mounted to the partition for supporting the heat exchanger;

a leg assembly connected to the partition for supporting a fan motor and a fan orifice within the opening defined by the heat exchanger; and wherein the fan orifice is also secured to at least one of the tube support assemblies to maintain the fan orifice in the desired position.

6. The apparatus as set forth in claim 5 and further comprising a front guard blocking those portions of the central opening other than where the fan orifice is located, said front guard being secured to both the tube support assemblies and to the fan orifice.

7. The apparatus as set forth in claim 5 wherein the leg assembly includes a plurality of fan motor support legs secured to the partition and to the fan motor and a plurality of fan orifice supports secured between the fan orifice and the fan motor support legs.

8. The apparatus as set forth in claim 7 wherein the fan orifice further comprises outwardly extending circumferential lips at each end of the orifice, one lip being engaged to the fan orifice supports and the other lip being engaged by tube support assemblies and the front guard.

9. The apparatus as set forth in claim 8 wherein the fan orifice is mounted to direct air flowing therethrough in a direction perpendicular to the partition.

* * * * *